US011889899B2

(12) United States Patent
Aoki et al.

(10) Patent No.: US 11,889,899 B2
(45) Date of Patent: Feb. 6, 2024

(54) SOLE AND SHOE WITH SOLE

(71) Applicant: Shimano Inc., Osaka (JP)

(72) Inventors: Toshiaki Aoki, Osaka (JP); Masaya Hashimoto, Osaka (JP)

(73) Assignee: Shimano Inc., Osaka (JP)

( * ) Notice: Subject to any disclaimer, the term of this patent is extended or adjusted under 35 U.S.C. 154(b) by 203 days.

(21) Appl. No.: 16/883,218

(22) Filed: May 26, 2020

(65) Prior Publication Data

US 2021/0007438 A1 Jan. 14, 2021

(30) Foreign Application Priority Data

Jul. 10, 2019 (JP) ..... 2019-128405

(51) Int. Cl.

| | |
|---|---|
| ***A43B 5/14*** | (2006.01) |
| ***A43B 13/14*** | (2006.01) |
| ***A43B 13/22*** | (2006.01) |
| ***A43B 13/26*** | (2006.01) |

(52) U.S. Cl.

CPC ..... *A43B 5/14* (2013.01); *A43B 13/14* (2013.01); *A43B 13/223* (2013.01); *A43B 13/26* (2013.01)

(58) Field of Classification Search

CPC ..... A43B 5/14
USPC ..... D2/908, 960
See application file for complete search history.

(56) References Cited

U.S. PATENT DOCUMENTS 3,952,428 A * 4/1976 Polsky ..... A43B 5/14 36/131
4,546,556 A * 10/1985 Stubblefield ..... A43B 13/223 36/114
4,550,510 A * 11/1985 Stubblefield ..... A43B 13/181 36/114
4,662,090 A * 5/1987 Solano ..... A43B 5/14 36/131
D291,943 S * 9/1987 Tong ..... D2/955
D294,537 S * 3/1988 Le ..... D2/960
5,125,173 A * 6/1992 Nagano ..... B62M 3/086 36/131
D331,490 S * 12/1992 Bramani ..... D2/960
5,185,943 A * 2/1993 Tong ..... A43B 13/184 36/35 R
D401,045 S * 11/1998 Greenberg ..... D2/960
6,725,742 B2 4/2004 Bremer
7,225,564 B1 6/2007 Gillespie
(Continued)

FOREIGN PATENT DOCUMENTS

EP 2 684 789 A2 1/2014
FR 2 427 800 1/1980
(Continued)

*Primary Examiner* — Jila M Mohandesi
(74) *Attorney, Agent, or Firm* — Global IP Counselors, LLP

(57) ABSTRACT

A shoe sole comprises a bottom surface including a plurality of grooves arranged in a longitudinal direction of the shoe sole for engaging the engagement parts 6*a,* 6*b* that are formed parallel to the pedal shaft 8 of the bicycle pedal, and a protrusion having a ground contact surface between the grooves adjacent in the longitudinal direction, the sole characterized in that the protrusion has a width W2 in the longitudinal direction on an inner side in the left-right direction with respect to both feet of a wearer that is wider than a width W1 on an outer side in the left-right direction with respect to both feet of a wearer.

15 Claims, 12 Drawing Sheets

(56) References Cited

U.S. PATENT DOCUMENTS

| | | | | | |
|---|---|---|---|---|---|
| 7,287,343 | B2 * | 10/2007 | Healy | A43B 13/223 | D2/908 |
| 7,533,480 | B2 * | 5/2009 | Chao | A43B 5/14 | 36/131 |
| 8,789,296 | B2 * | 7/2014 | Baker | A43C 15/02 | 36/134 |
| 8,794,105 | B2 * | 8/2014 | Delgorgue | A43B 5/14 | 74/594.6 |
| D717,034 | S * | 11/2014 | Bramani | A43B 13/223 | D2/951 |
| D724,828 | S * | 3/2015 | Lonigan | D2/951 | |
| D724,829 | S * | 3/2015 | Lonigan | D2/951 | |
| D768,367 | S * | 10/2016 | Henderson | D2/947 | |
| 9,504,293 | B2 * | 11/2016 | Tsang | A43B 13/184 | |
| 9,717,303 | B2 * | 8/2017 | Walker | A43B 13/141 | |
| D816,308 | S * | 5/2018 | Boys | D2/908 | |
| 10,070,688 | B2 * | 9/2018 | Lawless | A43B 3/0073 | |
| D833,723 | S * | 11/2018 | Benzien | A43B 13/184 | D2/951 |
| D840,138 | S * | 2/2019 | Brown | A43B 5/14 | D2/947 |
| D858,045 | S * | 9/2019 | Tæstensen | A43B 5/14 | D2/908 |
| D872,441 | S * | 1/2020 | Nickless | A43B 13/223 | D2/951 |
| D880,819 | S * | 4/2020 | Verfl | D2/954 | |
| D900,451 | S * | 11/2020 | Jury | D2/951 | |
| D901,155 | S * | 11/2020 | Comeaux | D2/947 | |
| 10,986,893 | B2 * | 4/2021 | Bunnell | A43B 17/02 | |
| 11,589,646 | B1 * | 2/2023 | Weschler | A43B 13/187 | |
| 2007/0017127 | A1 | 1/2007 | Chao et al. | | |
| 2011/0247237 | A1 * | 10/2011 | Jara | A43B 13/223 | 36/103 |
| 2020/0170339 | A1 * | 6/2020 | Verfl | A43B 13/181 | |

FOREIGN PATENT DOCUMENTS

| | | | |
|---|---|---|---|
| JP | 5-11802 | U | 2/1993 |
| JP | 5-124566 | A | 5/1993 |
| JP | 2010-268884 | A | 12/2010 |
| JP | 2014-511143 | A | 5/2014 |

* cited by examiner

SOLE AND SHOE WITH SOLE

CROSS-REFERENCE TO RELATED APPLICATIONS

This application claims priority to Japanese Patent Application No. 2019-128405, filed on Jul. 10, 2019. The entire disclosure of Japanese Patent Application No. 2019-128405 is hereby incorporated herein by reference.

BACKGROUND

Technical Field

The present invention generally relates to a shoe sole used for a bicycle pedal and a shoe provided with the shoe sole.

Background Information

Some bicycle pedals include front and rear engagement parts (projections or end faces of the frame of the pedal) extending in the left-right direction parallel to the pedal shaft. In order to prevent the shoe sole coming off the pedal when the shoe sole is placed on the bicycle pedal and pedals the bicycle pedal, the bottom surface of the shoe sole is provided with a plurality of grooves that are formed at intervals in the longitudinal direction so that the plurality of grooves engages the pair of front and rear engagement parts. These grooves are formed of grooves extending in the left-right direction that is a direction perpendicular to the longitudinal direction of the shoe sole. For example, such a shoe sole is disclosed in Japanese Application Laid-Open No. 2010-268888 (hereinafter referred to as Patent Document 1) and as seen in FIG. 5 of Patent Document 1.

SUMMARY

According to the configuration of Patent Document 1, since the direction in the pair of front and rear engagement parts and the direction in which the plurality of grooves are formed are the same direction, the front engagement parts, which are located on the front side over the entire left and right length, will be located in the groove with little gap. At the same time, the rear engagement part may be engaged in the groove located on the rear side over the entire left and right length with a small gap. In this case, the locking force becomes extremely large resulting in there being a disadvantage in that the operation feeling is not good because the shoe sole is too firmly fixed to the pedal.

Also, when the pedal is stepped on at the portion of the sole of the foot behind the thumb ball of the foot, the wearer's foot tends to open and turn slightly outward. In addition, when the pedal is stepped on at the front side of the sole, the wearer's foot tends to be turn slightly inward. Therefore, if the direction in which the plurality of grooves are formed in a direction intersecting with the direction in the engagement part of the pedal, as described above, then the grooves can only partially engage the engagement part of the pedal, and the pedaling force is not effectively transmitted to the pedal, which leaves room for improvement.

The shoe sole and the shoe provided with the shoe sole of the present disclosure have been made in view of the above-described circumstances. Thus, the shoe sole and the shoe of the present disclosure provides a shoe sole and a shoe provided with a shoe sole, which not only can be reliably engaged with a pedal but also can be reliably engaged even if the wearer turns the wearer's foot according to a tendency of the wearer.

The shoe sole of the present disclosure comprises a bottom surface including a plurality of grooves arranged in a longitudinal direction of the shoe sole for engaging the engagement parts that are formed parallel to the pedal shaft of the bicycle pedal, and a protrusion having a ground contact surface between the grooves adjacent in the longitudinal direction, the sole characterized in that the protrusion has a width in the longitudinal direction on an inner side in the left-right direction with respect to both feet of a wearer that is wider than a width on an outer side in the left-right direction with respect to both feet of the wearer.

According to the present disclosure, the protrusion has a width in the longitudinal direction on the outer side in the left-right direction that is narrower than a width in the longitudinal direction on the inner side in the left-right direction. Thereby, the grooves extend in a direction intersecting the left-right direction. One of the grooves is engaged to the front or rear engagement part of the bicycle pedal over the entire left and right length when the grooves are respectively engaged to the front and rear engagement parts of the bicycle pedal. While, at the same time, the other groove is not engaged to the other engagement part on the rear side or the front side of the bicycle pedal over the entire left and right length. Therefore, the engaging force can be generated appropriately. Further, even when the shoe sole is engaged to the bicycle pedal with the foot slightly opened and turned outward or turned inward, at least one of the front and rear engagement parts of the bicycle pedal reliably be engaged with the groove.

In addition, in the shoe sole of the present disclosure, the plurality of grooves includes at least one first groove formed so that a center line extends in the left-right direction that is perpendicular to the center line of the shoe sole in the longitudinal direction and a plurality of second grooves disposed before and after the first groove respectively, and the plurality of second grooves is formed so that center lines of second grooves intersect the left-right direction. The center lines of the plurality of the second grooves on a front side of the first groove is inclined rearwardly towards the outer side in the left-right direction with respect to both feet of the wearer. The center lines of the plurality of the second grooves on a rear side of the first groove is inclined forwardly towards the outer side in the left-right direction with respect to both feet of the wearer. The first groove can be disposed in a region including spaced 20% to and including spaced 50% of a total length of the shoe sole from a front end of the shoe sole.

As described above, the first groove is arranged in the region including spaced 20% to and including spaced 50% of the total length of the sole from the front end of the shoe sole. The plurality of second grooves have an opposite inclination direction before and after the first groove, respectively. Therefore, even if the direction of the shoe sole stepping on the bicycle pedal changes to be turned outward or turned inward, one of the second grooves on the front side of the first groove and the second grooves on the rear side of the first groove is in alignment with the direction of the engagement part of the bicycle pedal. It is possible for the one of the second groove (corresponding to the one of the engagement part) to be securely engaged to the one engagement part of the bicycle pedal.

In the shoe sole of the present disclosure, the first groove can be arranged in a region corresponding to a thumb ball of the wearer's foot.

As described above, by arranging the first groove in the region corresponding to the thumb ball of the foot where the force of the foot is relatively easy to apply, it is easy to reliably engage the second groove to the bicycle pedal.

Further, in the shoe sole of the present disclosure, the center lines of the second grooves can be inclined at an angle including 1 degree to and including 3 degrees with respect to the center line of the first groove.

As described above, since the center lines of the second grooves are inclined in a small range including 1 degree to and including 3 degrees with respect to the center line of the first groove, even when the wearer's foot moves back or forth, such that the second groove can be aligned according to the direction of the foot.

Furthermore, the shoe can be provided with the shoe sole described above.

As in the present disclosure, since the shoe sole has a protrusion in which the width in the longitudinal direction on the outer side in the left-right direction is narrower than the width in the longitudinal direction on the inner side in the left-right direction, the grooves can be appropriately engaged with the pedal. In addition, it is possible to provide a shoe sole and a shoe provided with the shoe sole, which can reliably hold the pedal in the groove in accordance with a tendency of the wearer to turn the foot.

BRIEF DESCRIPTION OF THE DRAWINGS

Referring now to the attached drawings which form a part of this original disclosure.

DETAILED DESCRIPTION OF EMBODIMENTS

Figure 1:
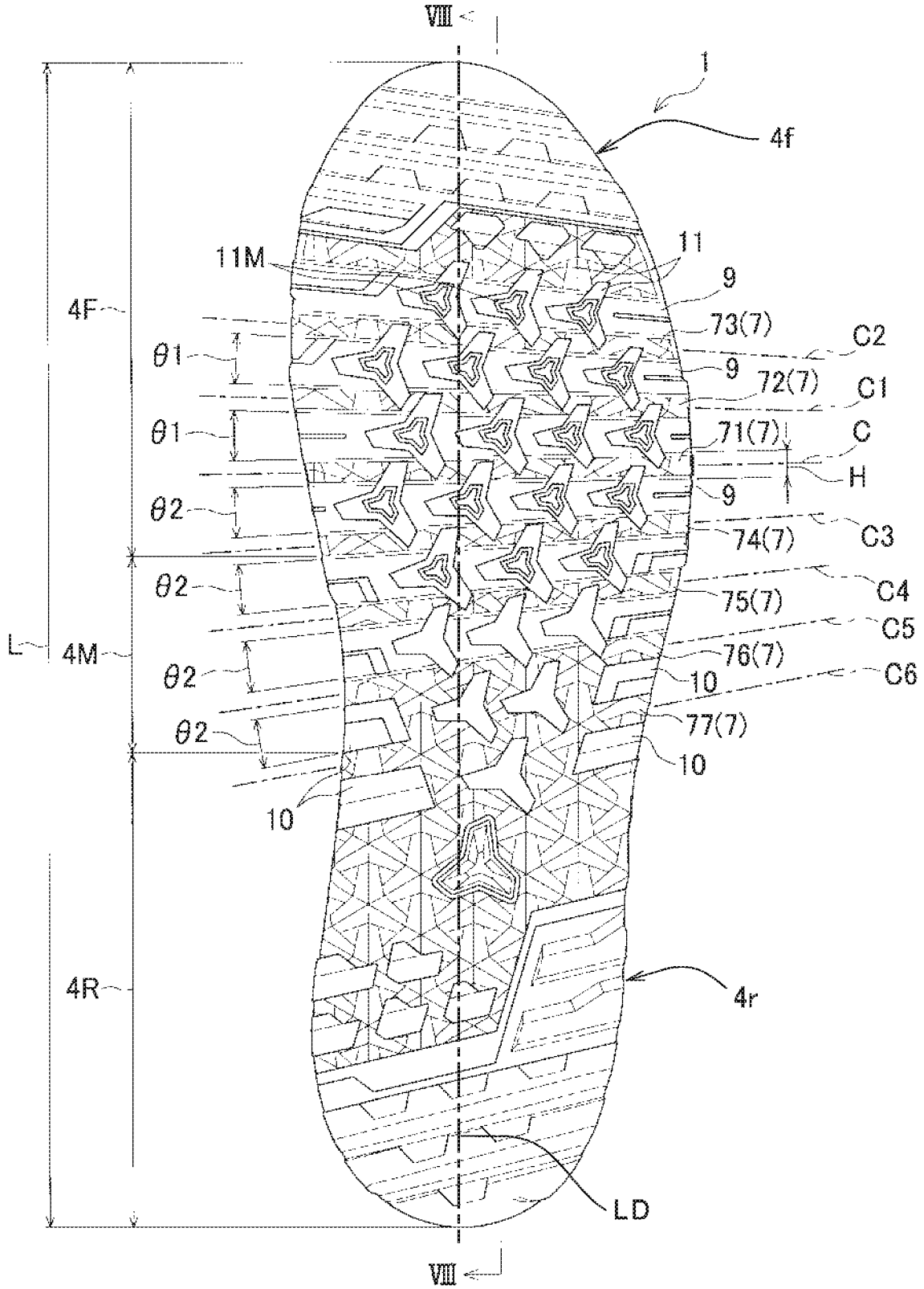
FIG. 1 is a bottom plan view of a left shoe sole in accordance with one illustrative embodiment of the present disclosure.
Figure 2:
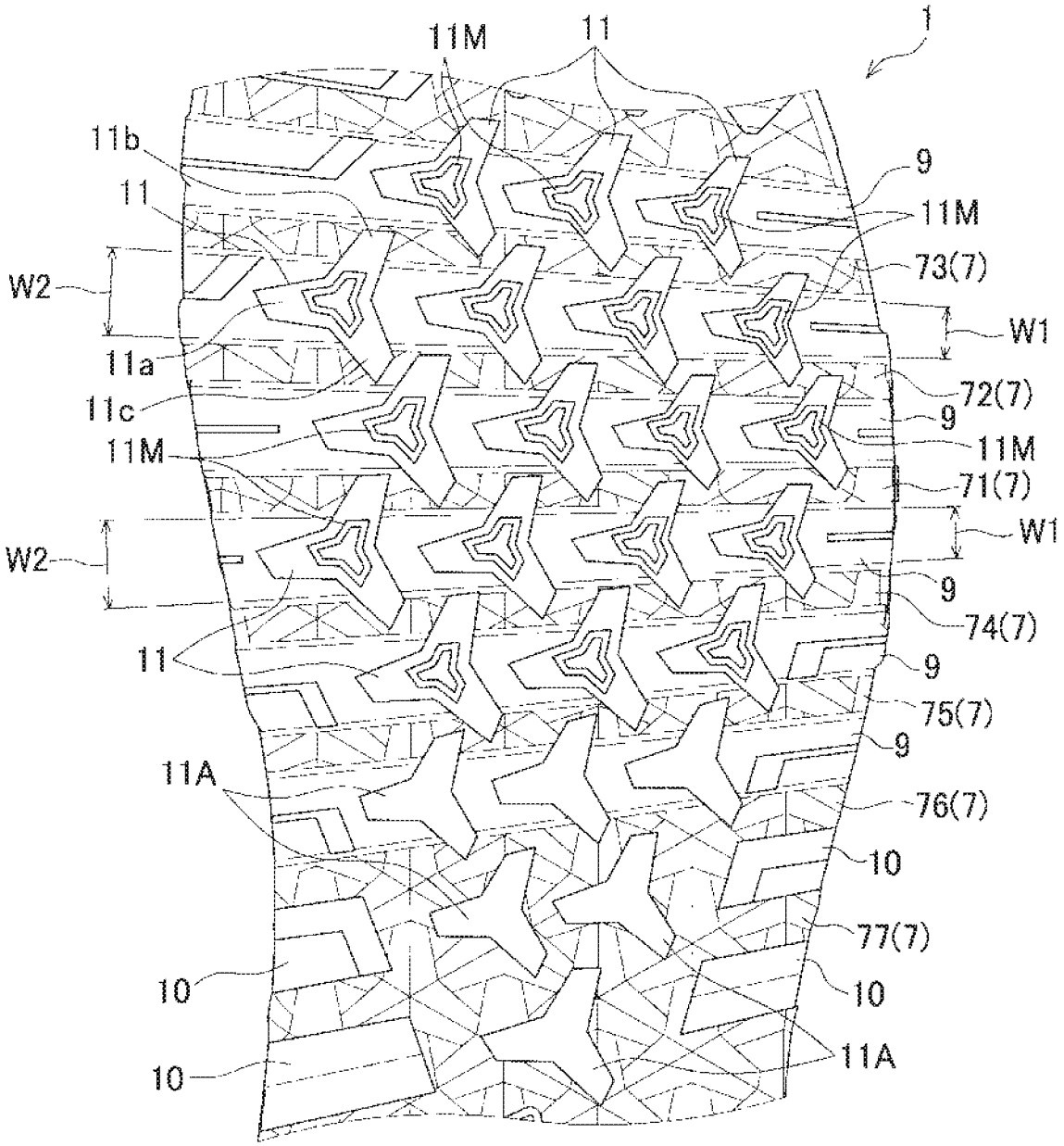
FIG. 2 is a bottom plan view showing a part of the shoe sole illustrated in FIG. 1.
Figure 3:
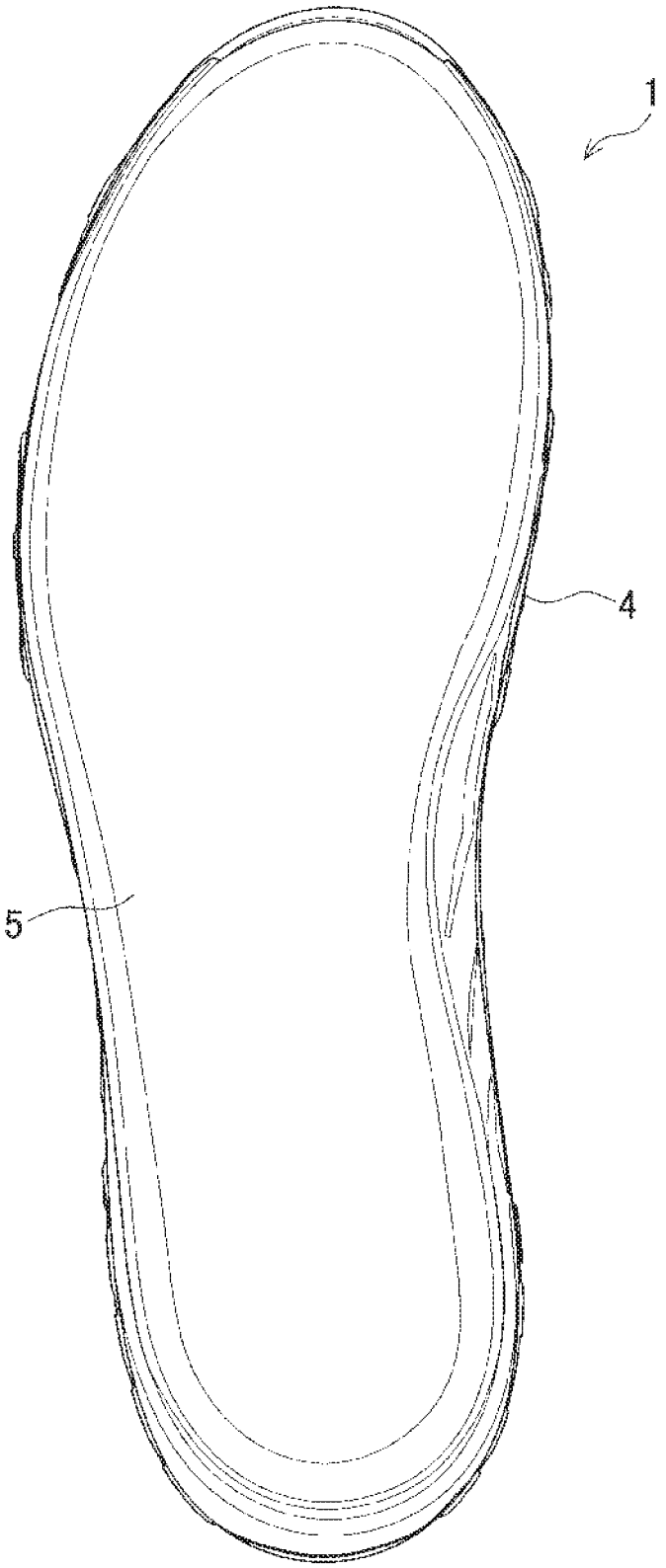
FIG. 3 is a top plan view of the shoe sole illustrated in FIG. 1.
Figure 4:
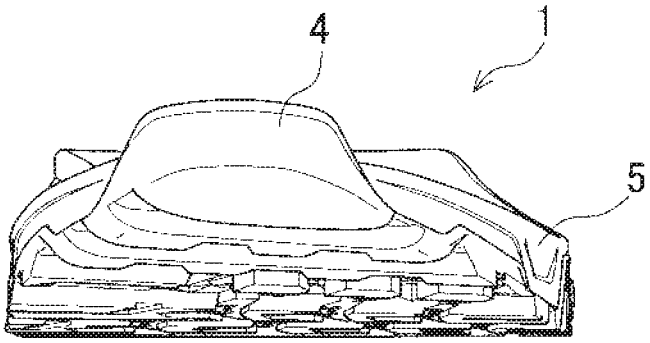
FIG. 4 is a front elevational view of the shoe sole illustrated in FIG. 1.
Figure 5:
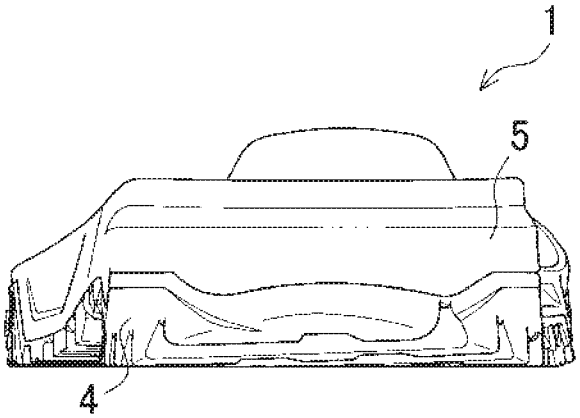
FIG. 5 is a rear elevational view of the shoe sole illustrated in FIG. 1.
Figure 6:
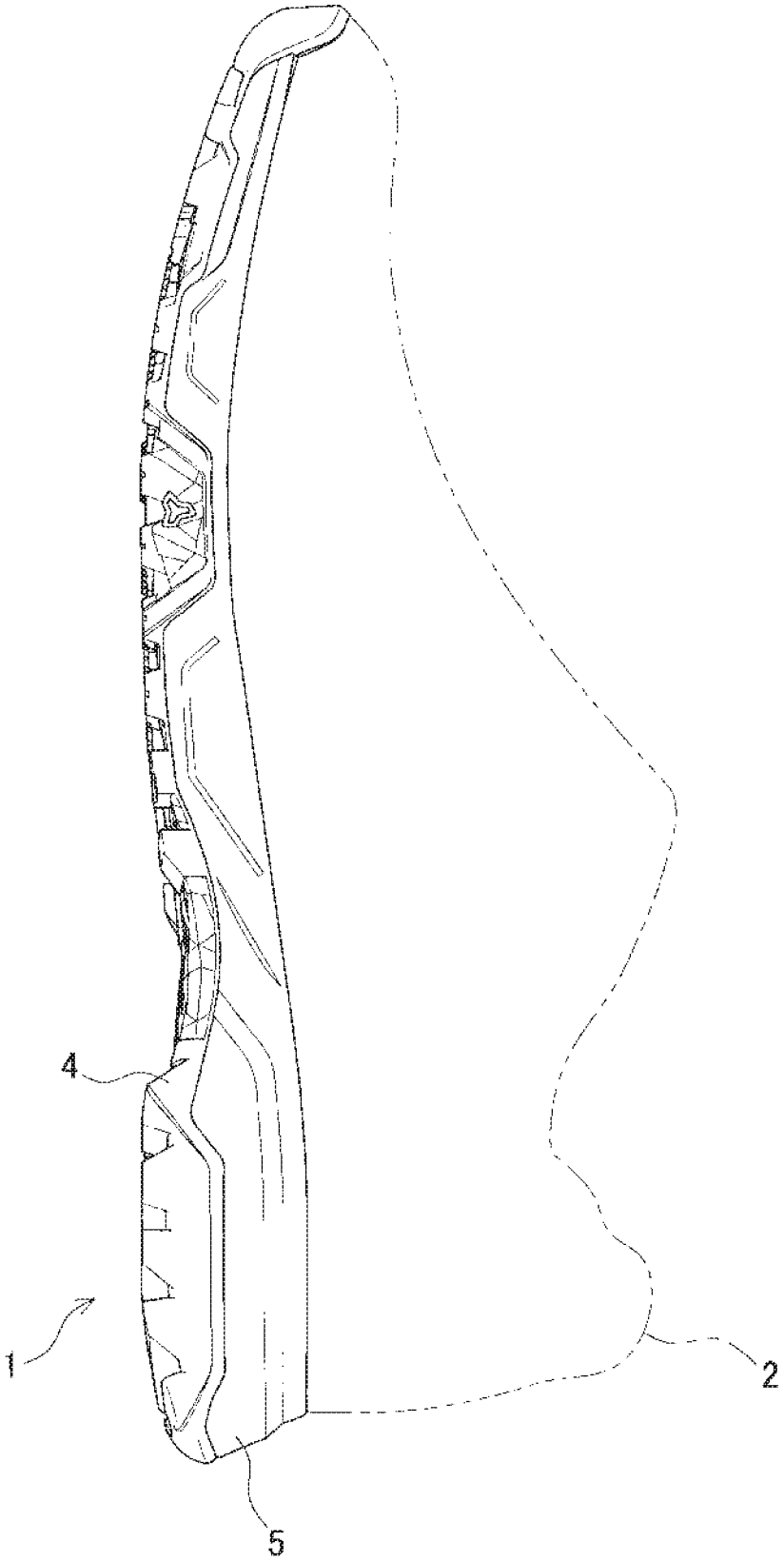
FIG. 6 is a left side elevational view of the shoe sole illustrated in FIG. 1.
Figure 7:
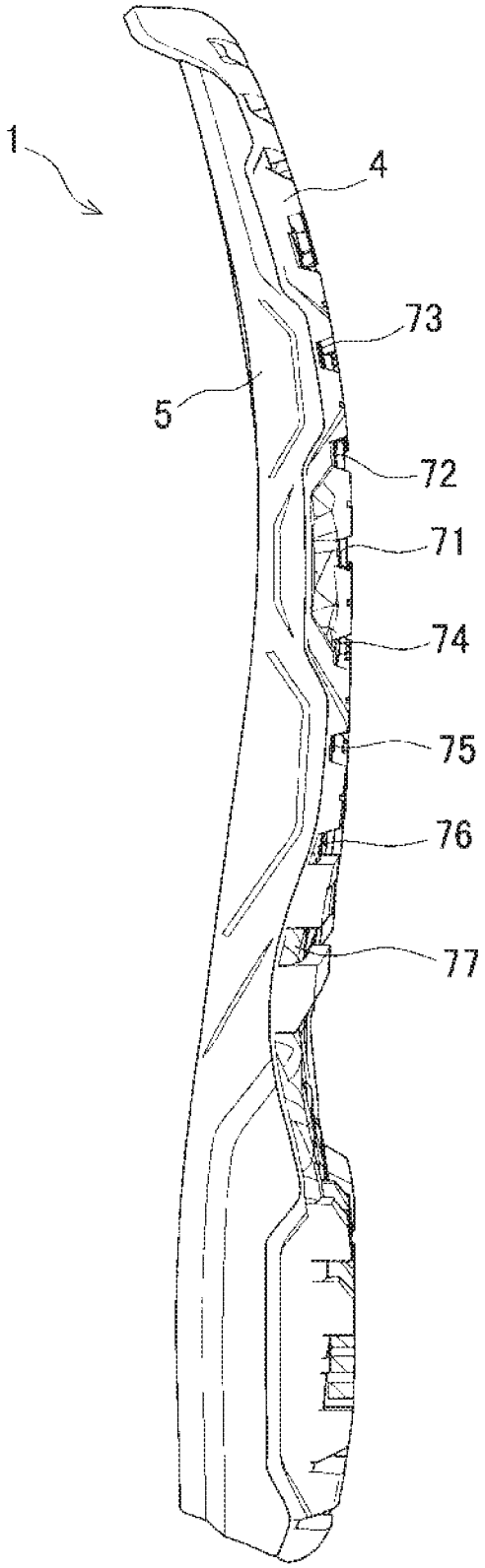
FIG. 7 is a right side elevational view of the shoe sole illustrated in FIG. 1.
Figure 8:
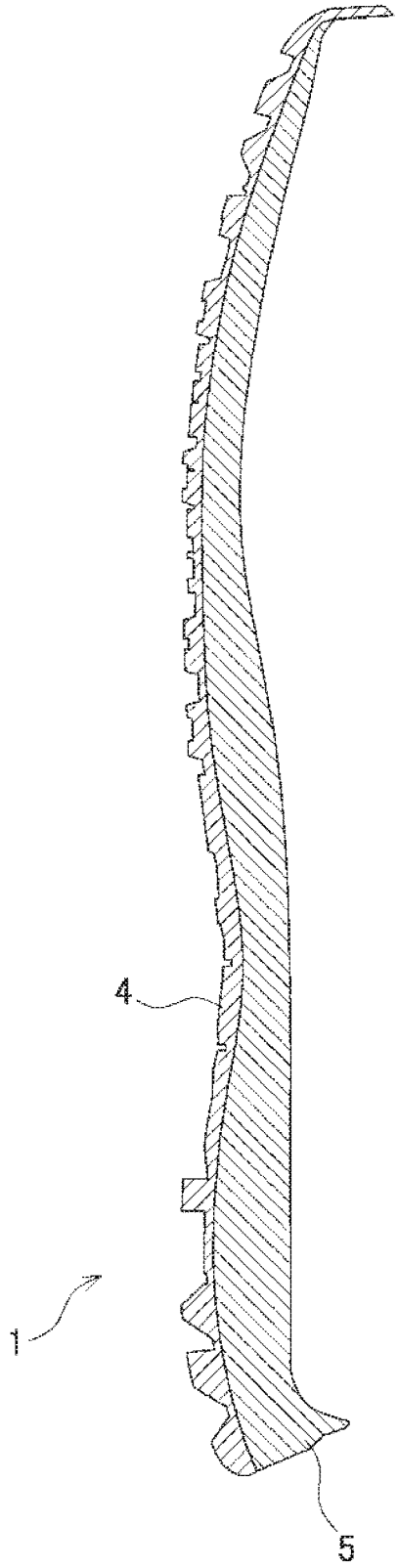
FIG. 8 is a longitudinal cross sectional view of the shoe sole illustrated in FIG. 1 taken along line VIII-VIII in FIG. 1.
Figure 9:
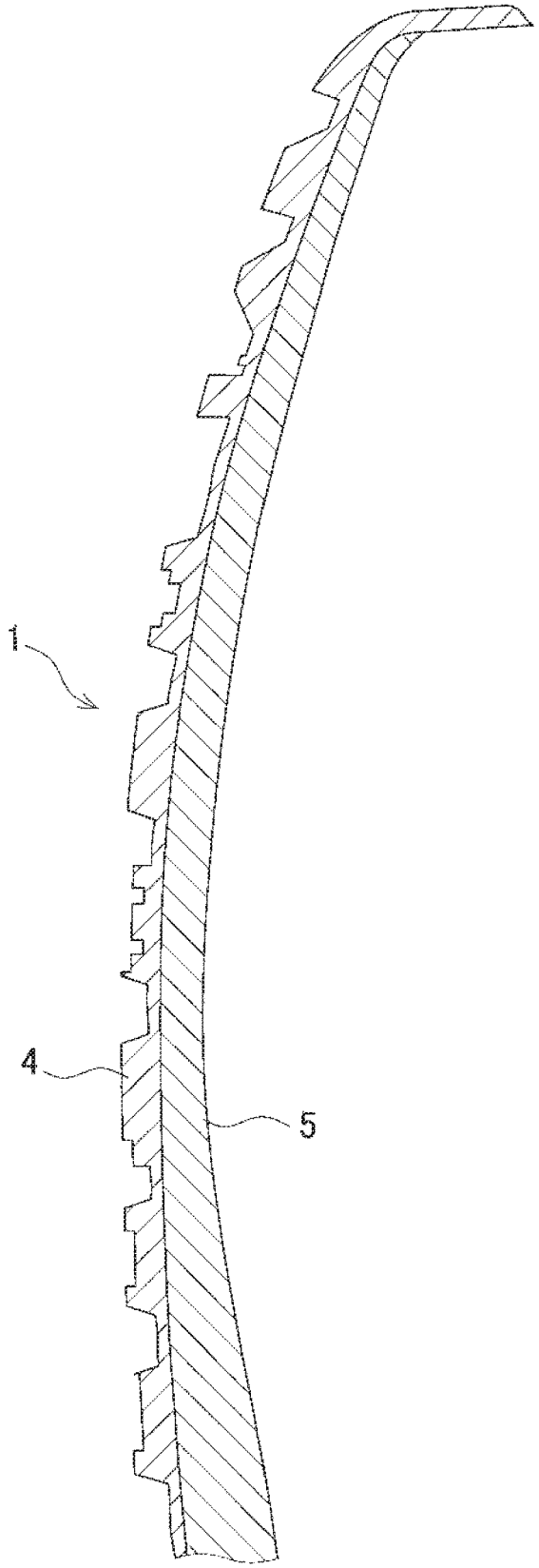
FIG. 9 is an enlarged longitudinal cross sectional view of the front side of the shoe sole illustrated in FIG. 8.

Hereinafter, selected embodiments will be described with reference to the drawings. It will be apparent to those skilled in the bicycle field from this disclosure that the following descriptions of the embodiments are provided for illustration only and not for the purpose of limiting the invention as defined by the appended claims and their equivalents.

FIGS. 1 to 9 show a shoe sole 1 in accordance with one illustrative embodiment of the present disclosure. The shoe sole 1 shows the left one of a pair of left-right symmetric ones, in which the right one is omitted. The shoe 3 is constituted by providing the shoe sole 1 with an upper part 2 shown by a two-dot chain line in FIG. 6. The shoe sole 1 includes an outsole 4 and a midsole 5 fixed on the outsole 4 with an adhesive or the like. In addition, the sole 1 has a countermeasure so that when the pedal 6 is stepped on so that the pedaling force from the sole 1 to a bicycle pedal (hereinafter simply referred to as a pedal) 6 (see FIG. 10) can be efficiently transmitted. The shoe sole has hardness that does not deform due to force.

The outsole 4 is made of, for example, an elastic polymer material such as synthetic rubber or polyurethane, and has an outer shape formed in a foot shape. Further, the bottom surface (lower surface) of the outsole 4 includes a plurality of grooves 7 for engaging the front and rear engagement parts 6*a* and 6*b* of the pedal 6, which are later described, in a longitudinal direction LD of the shoe sole 1.

Figure 10:
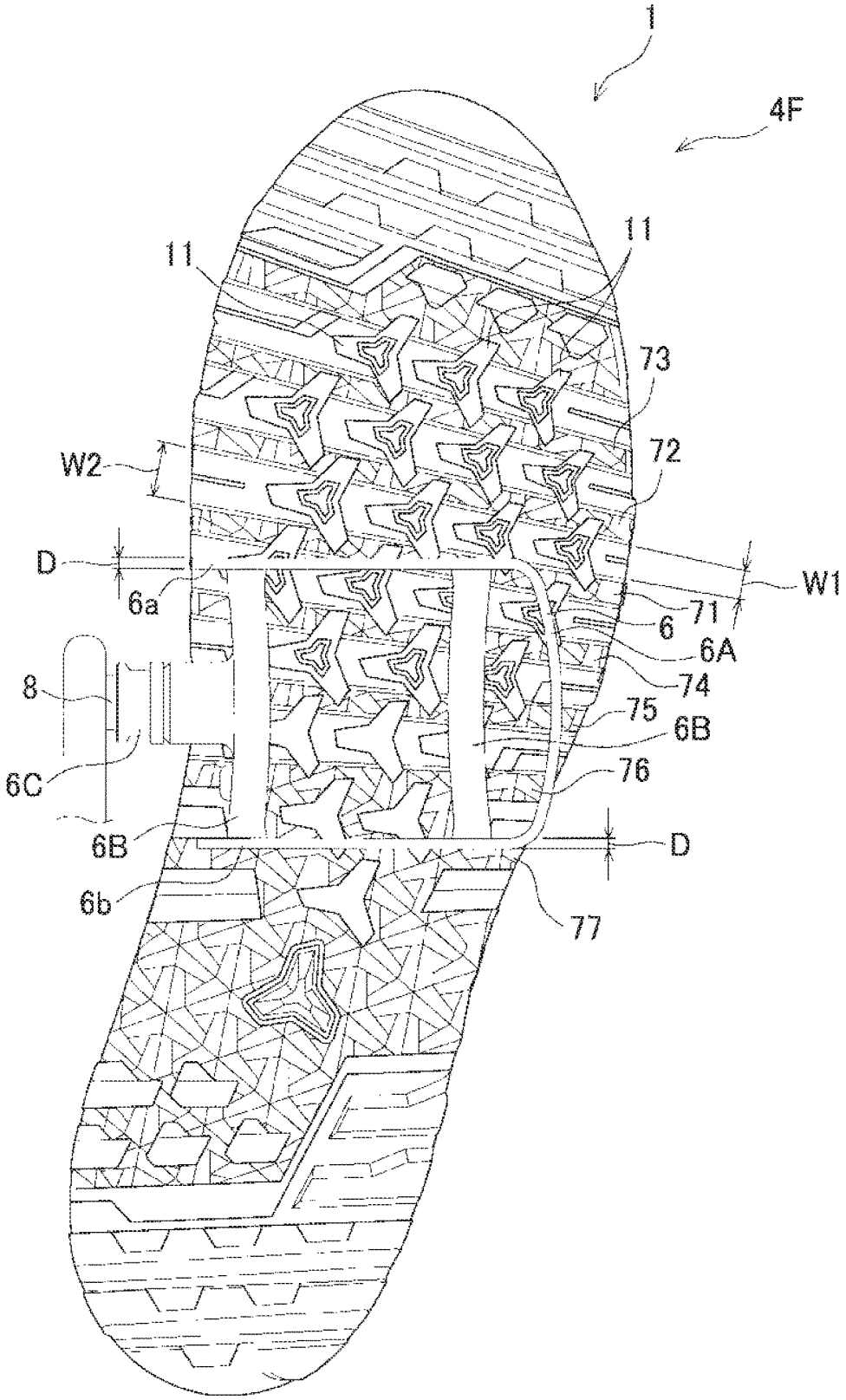
FIG. 10 is a bottom plan view of the shoe sole illustrated in FIG. 1 and a bicycle pedal showing a state where the shoe sole is engaged with the bicycle pedal.

As shown in FIG. 10, the pedal 6 has a U-shaped frame portion 6A, a pair of left and right connection portions 6B, 6B connecting the insides of the frame portion 6A in the longitudinal direction, and a mounting boss 6C protruding inwardly from the left-right insides of the connecting portion 6B located inside the left-right direction and attached to a shaft 8. The frame portion 6A includes a pair of front and rear engagement parts 6*a* and 6*b* extending in the left-right direction parallel to the shaft 8. In this embodiment, the pair of front and rear engagement parts 6*a* and 6*b* are plate-like members extending linearly in the left-right direction, but can include a plurality of protrusions arranged at intervals in the left-right direction. The projections can be formed integrally with the engagement part, or can be formed by screwing a plurality of separate rod-shaped members into the pedal 6 at intervals along the left-right direction. In this embodiment, the thickness of each of the engagement parts 6*a* or 6*b* in the longitudinal direction is 2.5 mm, but is preferably in a range including 1.5 mm to and including 3 mm.

The midsole 5 is made of, for example, EVA (ethylene-vinyl acetate copolymer), and has an outer shape in a foot shape.

The outsole 4 includes a forefoot 4F located on the front side, a posterior foot 4R located on the rear side, and a midfoot 4M located between the forefoot 4F and the posterior foot 4R. The plurality of grooves 7 are formed in a portion including the forefoot 4F that is excluded the front end of the forefoot 4F and in the forefoot side of the midfoot 4M. In addition, a front end 4*f* of the forefoot 4F, a rear end 4*r* of the posterior foot 4R, and a portion placed between them which portion includes protrusions 9, recesses 11, and protrusions 10, described later include ground contact surfaces that contact the ground when the wearer is walking. It is preferable that the ground surface ratio of the ground contact surface corresponding to the wearer's outsole 4 positions of the toe phalanges and metatarsal be in the range including 50% to and including 75%.

Each of the plurality of (seven in FIG. 1) grooves 7 has a constant width H in the longitudinal direction from the left-right inner end to the left-right outer end based on both feet of the wearer (see FIG. 1). Therefore, the front end and the rear end of the groove 7 are parallel. Further, the width H in the longitudinal direction is preferably larger than a thickness in the longitudinal direction of the engagement part 6*a* or 6*b* of the pedal 6, for example, preferably in a range including 5 mm to and including 8 mm, and more preferably in a range including 6 mm to and including 8 mm.

Further, the plurality of grooves 7 includes one linear first groove 71 that is formed so that a center line C extends in the left-right direction perpendicular to the sole center line of the shoe sole 1, which extends in the longitudinal direction, and the plurality of grooves 7 includes a plurality of linear second grooves 72 to 77 (a total of six grooves including two on the front side and four on the rear side in FIG. 1) that is respectively arranged before and after in the longitudinal direction of the first groove 71 and that are formed so that center lines C1 to C6 intersects the left-right direction. The center lines C1 and C2 of the plurality of (two) second grooves 72 and 73 on the front side are inclined rearwardly towards the outside in the left-right directions, and the center lines C3, C4, C5, and C6 of the plurality of (four grooves) second grooves 74, 75, 76 and 77 on the rear side are inclined forwardly towards the outside in the left-right directions. In other words, the second groove 72 is inclined at an angle θ1 (the angle θ1 is 2.5 degrees) with respect to the first groove 71, and the second groove 73 is inclined at an angle θ1 (the angle θ1 is 2.5 degrees) with respect to the second groove 72. In addition, the second groove 74 is inclined at an angle θ2 (the angle θ2 is 2.5 degrees at the same angle as θ1) with respect to the first groove 71, the second groove 75 is inclined at an angle θ2 (the angle θ2 is 2.5 degrees at the same angle as θ1) with respect to the second groove 74, the second groove 76 is inclined at an angle θ2 (the angle θ2 is 2.5 degrees at the same angle as θ1) with respect to the second groove 75, and the second groove 77 is inclined at an angle θ2 (the angle θ2 is 2.5 degrees at the same angle as θ1) with respect to the second groove 76. Thus, by setting the angles θ1 and θ2 equal to 2.5 degrees, as described above, when the radially drawn center lines C to C6 are extended to the right side, it is possible for them to converge at one point. The angles θ1 and θ2 are not limited to 2.5 degrees, but can be set to an arbitrary numerical value in the range including 1 degree to and including 3 degrees. The center line of the sole in the longitudinal direction of the shoe sole 1 is a straight line connecting the front end and the rear end of the shoe sole 1.

Further, the first groove 71 is preferably arranged in a region including spaced 20% to and including spaced 50% of the total length L from the front end of the shoe sole 1 towards the rear end from the front end of the sole 1. More preferably, the region where the first groove 71 is arranged is a region corresponding to the thumb ball of the foot (the range including 20% to and including 40% of the total length L of the sole 1 from the front end of the sole 1). In this embodiment, the first groove 71 is arranged in a range including 30% to and including 40% of the total length L of the sole 1 from the front end of the sole 1. As described above, the first grooves 71 are arranged in the region including spaced 20% to and including spaced 50% of the total length L of the shoe sole 1 from the front end of the shoe sole 1, and the plurality of (for example, seven grooves) the second grooves 72 to 77 are respectively provided before and after the first groove 71, so that even if the position of the sole 1 for stepping on the pedal 6 is changed back and forth, at least one of the second grooves 72 and 73 on the front side of the first groove 71 and the second grooves 74 to 76 on the rear side of the first groove 71 can be reliably engaged with the pedal 76.

The first groove 71 is formed between the linear protrusions 9, 9 that are disposed in front and rear. The linear protrusions 9 have a ground contact surface extending in the left-right direction, and the width of each of the protrusions 9 in the longitudinal direction is wider than the width of the first groove 71. In addition, each of the protrusions 9 has a width W2 in the longitudinal direction on the inner side in the left-right direction with respect to both feet of the wearer. The width W2 is wider than a width W1 in the longitudinal direction on the outer side in the left-right direction with respect to both feet of the wearer. Specifically, the width in the longitudinal direction of each of the protrusions 9 is tapered to narrower (smaller) toward a lateral outside end from a lateral inside end. The second grooves 72, 73, 74 and 75 are also formed between the protrusions 9, 9 in the same way. The second groove 77, which is the first groove from the rear is formed between the left and right protrusions 10, 10 on the front side and the left and right protrusions 10, 10 on the rear side. The protrusions 10 are arranged at both left and right end portions and where there is no intermediate part in the left-right direction of the protrusion 9. The second groove 76, which is the second groove from the rear is formed between the protrusion 9 positioned on the front side and the left and right protrusions 10, 10 positioned on the rear side.

Also, a plurality of (four recesses in FIG. 1) first recesses 11 is formed at intervals in the left-right direction in each of the protrusions 9. The plurality of the first recesses 11 formed on the protrusions 9 formed upper side and the plurality of the first recesses 11 formed on the protrusions 9 formed lower side are formed so as to be shifted in the longitudinal direction. Each of the first recesses is formed in a three-way shuriken shape including three flat surfaces 11*a*, 11*b* and 11*c* that extend in three directions. Of these flat surfaces 11*a*, 11*b*, 11*c*, the flat surface 11*b* extending forward protrudes into the second groove 73 formed in the upper side and the flat surface 11*c* extending backward protrudes into the second groove 72 formed in the lower side. The three flat surfaces 11*a*, 11*b*, 11*c* are lower than the upper surface of the projection 9 and higher than the bottom surfaces of the first groove 71 and the second grooves 72 to 77. An annular groove 11M having a three-way shuriken shape is formed at a center of the first recesses 11. A plurality of second recesses 11A, in which the grooves 11M are not formed, are formed in three rear rows. Each of the second recesses 11A has the same outer shape and size as the first recesses. Further, in the left-right direction the number of the second recesses 11A located on the rear side is smaller than the number of the second recesses 11A located on the front side.

As described above, each protrusion 9 has the width W2 in the longitudinal direction on the inner side in the left-right direction with respect to both feet of the wearer. The width W2 is wider than the width W1 in the longitudinal direction on the outer side in the left-right direction with respect to both feet of the wearer (See FIGS. 2 and 10). With this configuration, the first groove 71 and the second grooves 72 to 77 can be more reliably engaged with the engagement parts 6*a* and 6*b* at the front and rear of the pedal 6 according to the tendency of the opening of the foot. In addition, by providing a plurality of the second grooves 72, 73 and 74 to 77 disposed before and after the first groove 71 and having opposite inclination directions, respectively. The direction of the shoe sole on which the pedal 6 is stepped on changes to turn outward or turn inward. Even in such a case, one of the second grooves 72, 73 disposed on the front side of the first groove 71 and the second grooves 74 to 77 disposed on the rear side of the first groove 71 is engaged with the engagement part 6*a* or 6*b* of the pedal 6. Thus, one of the engagement part 6*a* or 6*b* can surely engage with one of the second grooves 72, 73 and 74 to 77 corresponding the engagement part 6*a* or 6*b*.

Figure 11:
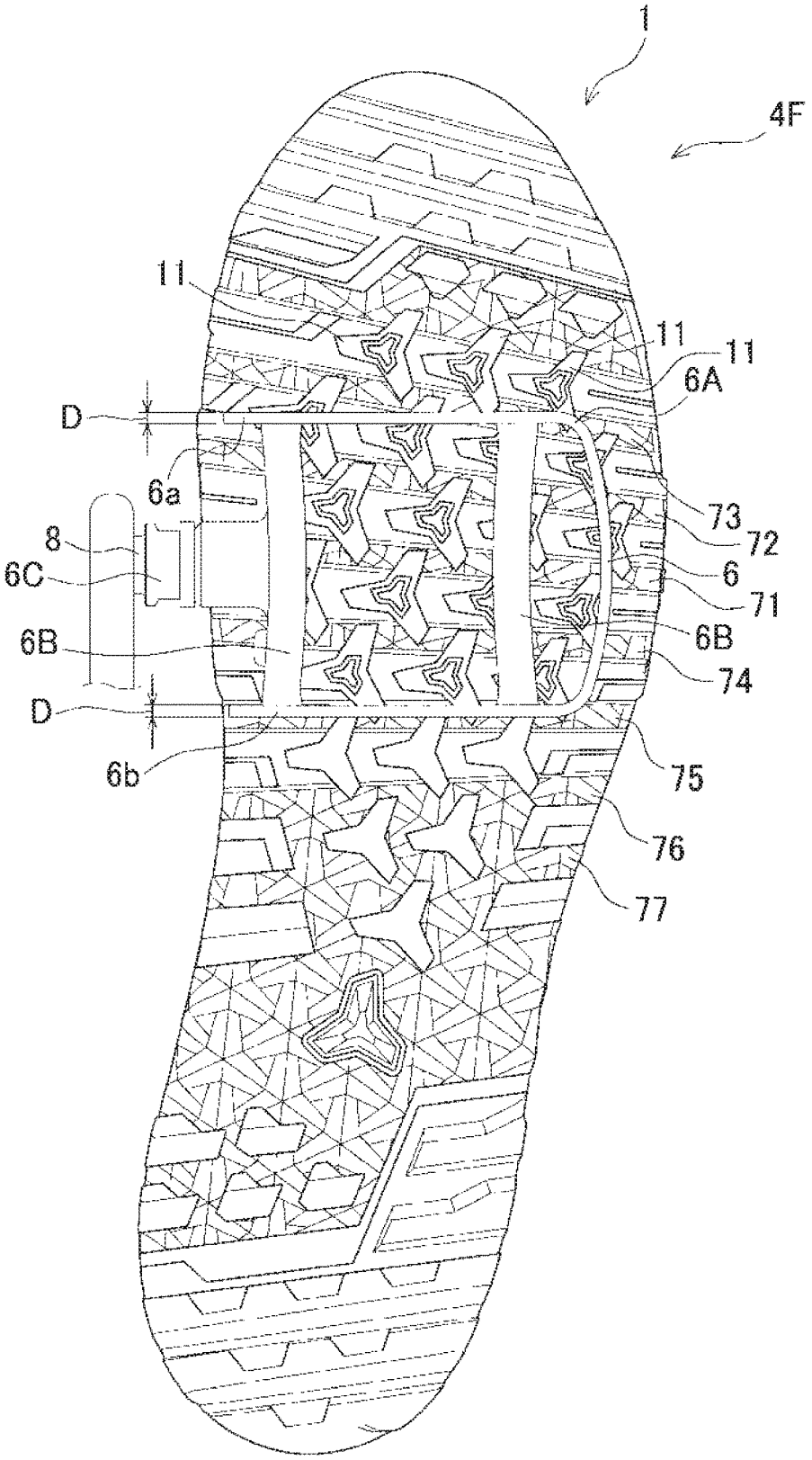
FIG. 11 is a bottom plan view of the shoe sole illustrated in FIG. 1 and the bicycle pedal showing a state in which the shoe sole is engaged with the bicycle pedal at a position different from that of FIG. 10.
Figure 12:
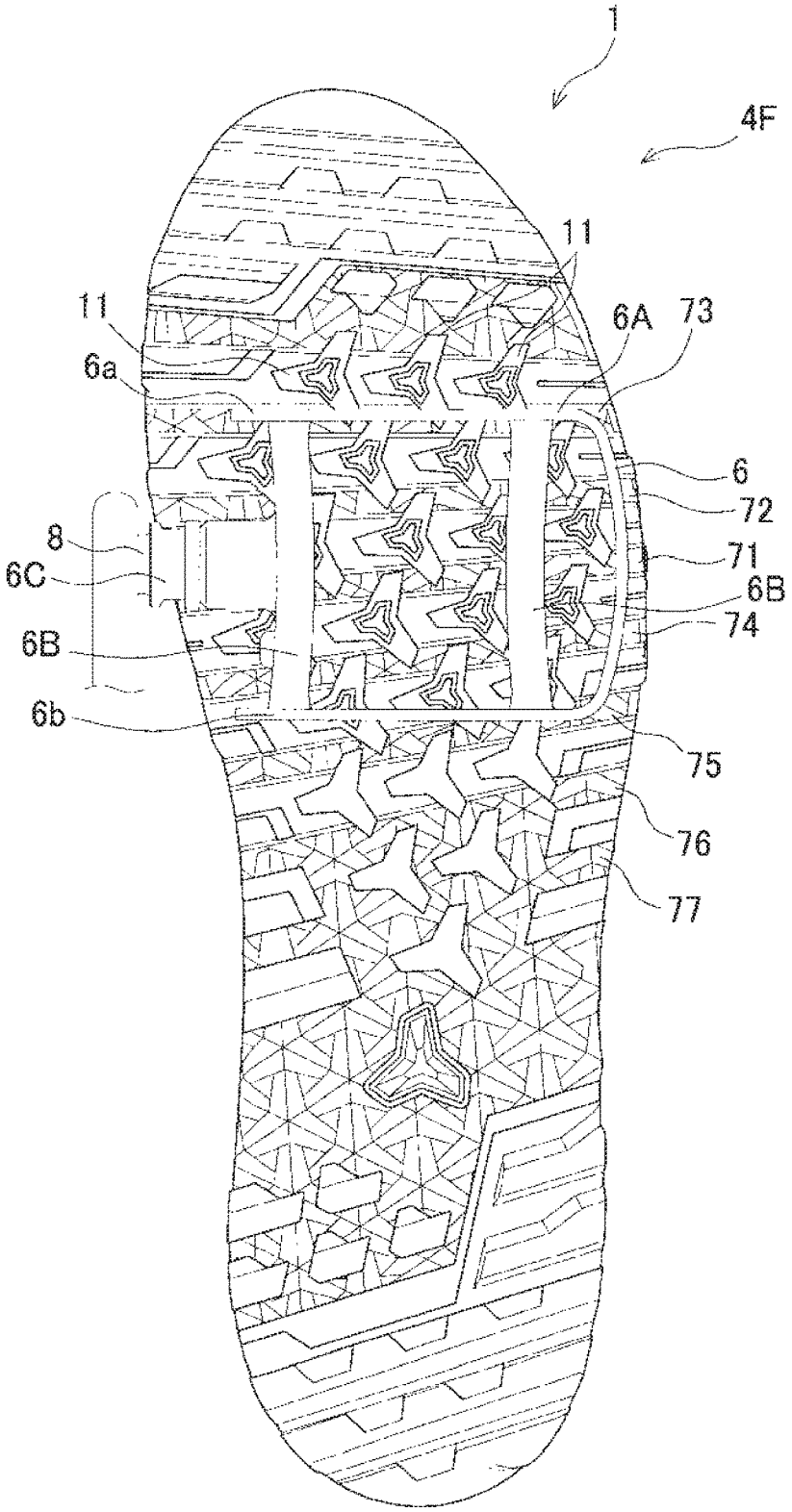
FIG. 12 is a bottom plan view of the shoe sole illustrated in FIG. 1 and the bicycle pedal showing a state in which the shoe sole is engaged with the bicycle pedal at a position different from FIGS. 10 and 11.

FIGS. 10 to 12 show a state where the first groove and the second groove (71, 77 in FIG. 10) of the shoe sole 1 are engaged to the pair of front and rear engagement parts 6*a*, 6*b* of the pedal 6. FIGS. 10 to 12 show views of the pedal 6 as viewed from below. In FIG. 10, when the pedal 6 is stepped on at the part of the shoe sole 1 on the rear side of the thumb ball of the foot, the foot is opened slightly outward. In this case, the forefoot 4F of the shoe sole 1 is directed outward. The second groove 77 is the third groove from the front side among the second grooves 74 to 77 on the rear side of the first groove 71 directs in the direction which is the substantially same left-right direction of the rear engagement part 6*b* of the pedal 6. Thus, the rear engagement part 6*b* is engaged with the second groove 77 over the entire left and right region. On the other hand, since the first groove 71 has an inclination that intersects with the left-right direction of the front engagement part 6*a* of the pedal 6 (the inclination so that the inside is more forward). Thereby, only the outside part of the first groove 71 in the left-right direction is engaged with the outer end of the front engagement part 6*a* of the pedal 6 in the left-right direction. Thus, the engaging force acting on the front engagement part 6*a* of the pedal 6 is suppressed to be smaller than the engaging force acting on the rear engagement part 6*b* of the pedal 6 so that the engaging force is appropriately generated.

In FIG. 11, the pedal 6 is stepped on with the foot in a slightly outward turned state and the foot returned towards a substantially normal direction as compared to FIG. 10. Further, the pedal 6 is stepped on at the portion of the shoe sole 1 on the front side than shown in FIG. 10. In this case, since the front side part of the sole 1 is directed slightly outward turned, the second groove 75, the second from the front side among the second grooves 74 to 77 on the rear side of the first groove 71, is directed to the left-right directions in the substantially same direction as the rear engagement part 6*b* of the pedal 6 so that the rear engagement part 6*b* is engaged with the second groove 75 over the entire left and right region. On the other hand, since the second groove 73, which is located at the first from the front of the second grooves on the front side of the first groove 71, has an inclined posture that intersects with the left-right direction of the front engagement part 6*a* of the pedal 6 (the inclination is forwardly towards the inside). Therefore, only the outside part of the second groove 73 is engaged with the outer end of the front engagement part 6*a* of the pedal 6 in the left-right direction. Thus, the engaging force acting on the front engagement part 6*a* of the pedal 6 is suppressed to be smaller than the engaging force acting on the rear engagement part 6*a* of the pedal 6 so that the engaging force can be appropriately generated.

In FIG. 12, the pedal 6 is stepped on with the foot closed slightly inward turned state. In this case, the forefoot 4F of the shoe sole 1 is directed slightly inward turned. The second groove 73, which is located at the first from the front side among the second grooves 72, 73 on the front side of the first groove 71, is directed in the left-right direction which is the substantially same direction as the front engagement part 6*a* of the pedal 6. Thus, the front engagement part 6*a* is engaged with the second groove 73 over the entire left and right region. On the other hand, since the second groove 75, the second from the front side among the second grooves 74 to 77 on the rear side of the first groove 71, has inclined posture that intersects with the left-right direction of the rear engagement part 6*b* of the pedal 6 (the inclination is rearwardly towards the inside). Therefore, the outside part of the second groove 75 is engaged with the outer end of the rear engagement part 6*b* of the pedal 6 in the left-right direction. Thus, the engaging force acting on the rear engagement part 6*b* of the pedal 6 is suppressed to be smaller than the engaging force acting on the front engagement part 6*a* of the pedal 6 so that the engaging force can be appropriately generated.

In the present invention, by setting the inclination angles of the second grooves 72 to 77 to a small angle range of 1 degree to 3 degrees. Even when the wearer's foot moves back and forth, either of the second grooves 72, 73 or the second grooves 74 to 77 can be adjusted to the direction of the foot. Incidentally, the pedal 6 will be used based on an entire length of the sole 1 and an interval between the grooves 71 to 77 formed in the sole 1.

The shoe sole and shoes of the present invention are not limited to the above embodiments.

In the embodiment, only one of the first groove 71 is provided, but two or more can be provided, or it can be omitted.

Further, in the above-described embodiment, the inclination angles of all the second grooves 72 to 77 are set to be the same angle so that all the center lines converge at one point when the center lines are extended outward. However, by varying the inclination angles of some portion of the second grooves to be different from the inclination angles of the other second grooves, when the line extends outward, the second grooves converge at two or more points or can be configured not to converge at all.

In the above-described embodiment, while the number of the second grooves 72 and 73 on the upper side of the first groove 71 is smaller than the number of the second grooves 74 to 77 on the lower side of the first groove 71. However, the number of grooves 72, 73, 74 to 77 may be the same or, the number of second grooves on the upper side of the first groove can be larger than the number of the second grooves of the lower side the first groove.

What is claimed is:

1. A shoe sole comprising:

a bottom surface including a plurality of grooves arranged in a longitudinal direction of the shoe sole for engaging at least one engagement part formed parallel to a pedal shaft of a bicycle pedal, the bottom surface having a forefoot region, a posterior foot region and a midfoot region located between the forefoot region and the posterior foot region; and a first protrusion and a second protrusion, each of the first and second protrusions having a ground contact surface between the grooves adjacent in the longitudinal direction, each of the first and second protrusions having a first recess that defines a center, each of the first and second protrusions having a width in the longitudinal direction on an inner side in the left-right direction with respect to both feet of a wearer that is wider than a width in the longitudinal direction on an outer side in the left-right direction with respect to both feet of the wearer at the forefoot region and the midfoot region, the posterior foot region being free of the first and second protrusions, the first and second protrusions being arranged laterally with respect to each other to define a row of protrusions that is disposed in a space between two adjacent grooves as a single row of protrusions, each of the first and second protrusions abutting each of the two adjacent grooves.

2. The shoe sole according to claim 1, wherein the plurality of grooves includes at least one first groove formed so that a center line extends in the left-right direction that is perpendicular to a sole center line of the shoe sole in the longitudinal direction, and a plurality of second grooves disposed respectively before and after the first groove and formed so that center lines of second grooves extend across the left-right direction, and the center lines of the plurality of the second grooves on a front side of the first groove being inclined rearwardly towards the outer side in the left-right direction with respect to both feet of the wearer, and the center lines of the plurality of the second grooves on a rear side of the first groove being inclined forwardly towards the outer side in the left-right direction with respect to both feet of the wearer, the first groove being disposed in a region including spaced 20% to and including spaced 50% of a total length of the shoe sole from a front end of the shoe sole.

3. The shoe sole according to claim 2, wherein the first groove is arranged in a region corresponding to a thumb ball of the wearer's foot.

4. The shoe sole according to claim 2, wherein the center lines of the second grooves is inclined at an angle including 1 degree to and including 3 degrees with respect to the center line of the first groove.

5. The shoe sole according to claim 3, wherein the center lines of the second grooves is inclined at an angle including 1 degree to and including 3 degrees with respect to the center line of the first groove.

6. A shoe comprising the shoe sole according to claim 1, and further comprising:

an upper part coupled to the shoe sole.

7. The shoe sole according to claim 1, wherein the first recess has at least one recessed arm extending radially from a center of the first recess.

8. The shoe sole according to claim 7, wherein the at least one recessed arm includes three recessed arms each extending radially from the center of the first recess.

9. The shoe sole according to claim 7, wherein the first recess includes an annular groove having at least one groove arm formed at the center of the first recess.

10. The shoe sole according to claim 9, wherein the at least one groove arm includes three groove arms each extending radially from the center of the first recess.

11. The shoe sole according to claim 7, further comprising a plurality of protrusions that are identical to the protrusion, the shoe sole having a posterior foot area that is free of the plurality of protrusions.

12. The shoe sole according to claim 11, wherein the plurality of protrusions and the protrusion are first protrusions, the shoe sole further including a plurality of second protrusions, each of the second protrusions having a second recess and is free of an annular groove.

13. A shoe sole comprising:

a first protrusion having a first ground contact surface;

a second protrusion having a second ground contact surface;

a plurality of first slits disposed along an outer side edge of the shoe sole, and a plurality of second slits disposed along an inner side edge of the shoe sole, the first and second protrusions being arranged laterally with respect to each other to define a row of protrusions that is disposed in a space between a pair of adjacent first slits and a pair of adjacent second slits as a single row of protrusions, the first protrusion abutting each of the pair of adjacent first slits, the second protrusion abutting each of the pair of adjacent second slits; and a recess having a recessed surface with respect to the first and second protrusions, the recess having a groove formed at a center of the recess, the groove having at least one groove arm formed at the center of the recess, the at least one groove arm extending laterally between the plurality of first and second slits, the at least one groove arm extending inward of the slits with respect to the outer side edge.

14. The shoe sole according to claim 13, wherein the at least one groove arm includes three groove arms each extending radially from the center of the recess.

15. The shoe sole according to claim 14, further comprising a plurality of recesses, each of the recesses includes a corresponding groove having at least one groove arm.

* * * * *